US005156800A

United States Patent [19]

Buchet et al.

[11] Patent Number: 5,156,800

[45] Date of Patent: Oct. 20, 1992

[54] INSTALLATION FOR THE THERMAL/TREATMENT BEFORE ROLLING OF THIN SLABS PRODUCED BY CONTINUOUS-CASTING

[75] Inventors: Philippe Buchet, Boussy Saint-Antoine; Jean C. Mitais, Paris, both of France

[73] Assignee: Stein-Heurtey, Ris Orangis, France

[21] Appl. No.: 643,113

[22] Filed: Jan. 18, 1991

[51] Int. Cl.[5] ..... C21D 9/00; F27B 9/00

[52] U.S. Cl. ..... 266/99; 148/541; 266/103

[58] Field of Search ..... 266/99, 103; 148/128

[56] References Cited

U.S. PATENT DOCUMENTS

| | | | |
|---|---|---|---|
| 4,239,483 | 12/1980 | Iida et al. | 266/103 |
| 4,595,357 | 6/1986 | Sato et al. | 266/103 |
| 4,691,898 | 9/1987 | Imose et al. | 266/103 |
| 4,743,196 | 5/1988 | Imose et al. | 266/103 |
| 4,760,995 | 8/1988 | Fukuda et al. | 266/103 |

FOREIGN PATENT DOCUMENTS

| | | | |
|---|---|---|---|
| 2085327 | 7/1989 | France . | |
| 0038493 | 8/1983 | Japan | 266/103 |

OTHER PUBLICATIONS

Japanese Patent Abstract, Appln. No. 62-187337, vol. 13, No. 221, Nippon Ajiyatsukusu Magunesaamic K.K.

*Primary Examiner*—Upendra Roy

*Attorney, Agent, or Firm*—Pollock, VandeSande & Priddy

[57] ABSTRACT

An installation for the thermal treatment of metallurgical products, such as, particularly, thin slabs, obtained from at least one continuous-casting line and to be subjected to a rolling operation, which comprises:

an induction-heating furnace which is located at the exit of the continuous-casting line and the power of which is adjusted so as to increase the temperature of the slabs to a mean value determined by the rolling requirements, without correcting the local temperature heterogeneities of each slab and;

an equalizing or homogenizing furnace or zone located at the exit of said heating furnace, in order to correct the thermal heterogeneities inherent in each slab.

4 Claims, 1 Drawing Sheet

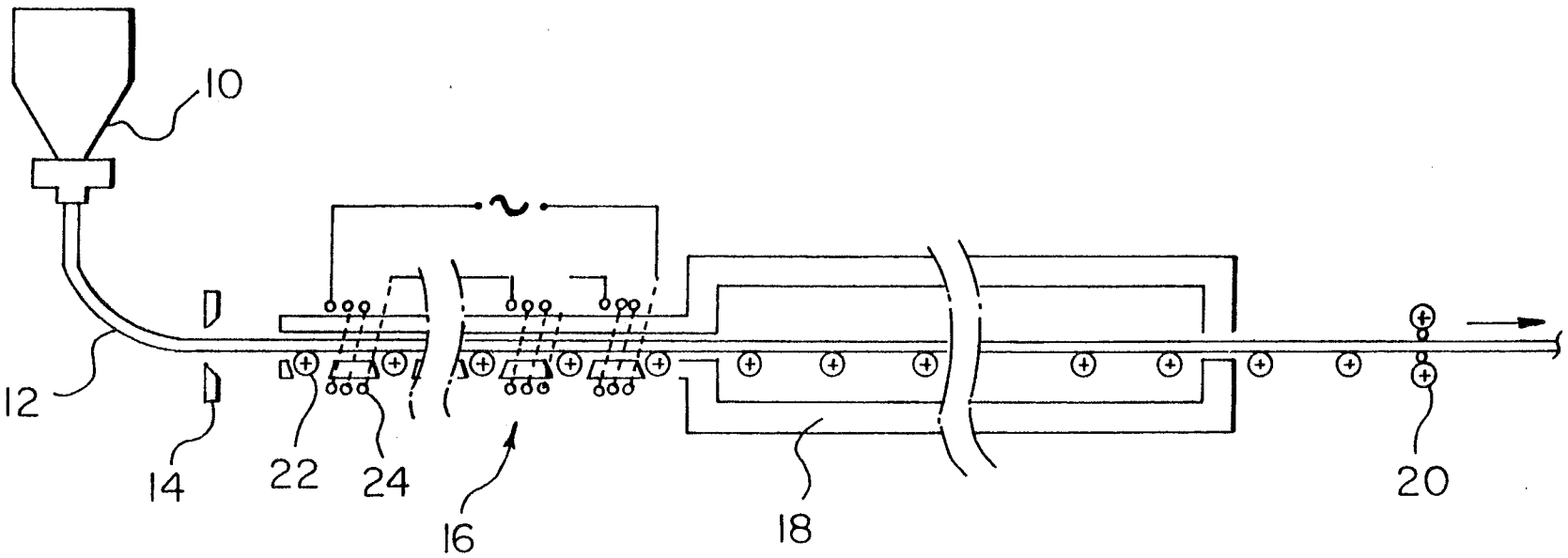
10
12
14
16
18
20
22
24

INSTALLATION FOR THE THERMAL/TREATMENT BEFORE ROLLING OF THIN SLABS PRODUCED BY CONTINUOUS-CASTING

BACKGROUND OF THE INVENTION

The present invention relates to the thermal treatment of metallurgical products, particularly, thin slabs, which are obtained by continuous casting and which subsequently have to be subjected to a rolling operation.

In mills for direct rolling of metallurgical products, such as thin slabs, obtained from one or two continuous-casting machines, it is necessary to subject the products, before they pass through the rolling mill, to a thermal rehomogenization and, if appropriate, heating treatment, in order to give the products uniform physical characteristics which make it possible to adhere to the rolling tolerances and obtain products of very high quality or top grade. Moreover, by ensuring good thermal homogeneity between slabs and a good temperature reproducibility, whatever the casting conditions, it is possible to obtain the rolling tolerances easily by means of simple adjustments of the rolls of the rolling mill.

To solve the problems thus presented, the present proprietor designed a roller furnace equipped with heating elements which are produced in the form of fossil-fuel burners having a high pulse. Moreover, similar results can be obtained by using heating means consisting of radiant elements.

In this type of known installation, the heating and homogenization of the products, such as thin slabs, are obtained by means of a travel of the slabs at a controlled speed through said roller furnace, in order to ensure a suitable dwell time of these slabs in the successive heating and then homogenization zones which compose the roller furnace. Because of the pronounced deviations which can exist between the temperatures of the start, middle and end of casting, to satisfy the heating requirements before homogenization it is necessary to provide installed heating powers corresponding to the most pronounced deviations and to define a dwell time and therefore a length of heating zone corresponding not only to this maximum temperature deviation, but also to the highest casting speeds.

This known solution has a major disadvantage in that, when it is used on a single continuous-casting line with a single rolling mill, it results in a minimum furnace length of the order of 100 to 150 m, depending upon the relative casting and rolling speeds and the product storage needs, and in deviations between installed powers and used powers of 1 to 10, depending on the entry temperature of the slab, thus making it difficult to operate the heating zones.

The development of mills comprising two continuous-casting lines and a single rolling line gives rise to installation lengths which can prove excessive in some configurations because of the necessary transfers of slabs from either one of the casting lines towards the rolling line, on the one hand, and the necessity to reserve a minimum storage zone to deal with transient situations, on the other hand.

SUMMARY OF THE INVENTION

The object of the present invention is to provide a solution to this problem which allows for the fact that two indispensable and mutually complementary operations are necessary to achieve the desired results at the entrance of the rolling line. In fact, it is necessary, on the one hand, to correct the temperature heterogeneities between the center, edges, head and tail of each thin slab and therefore make each slab homogeneous and, on the other hand, to bring all the slabs to the same temperature level.

The subject of this invention is, therefore, an installation for the thermal treatment of metallurgical products, such as thin slabs, obtained from at least one continuous-casting line and to be subjected to a rolling operation by an assembly comprising a single rolling line, defined in that it comprises:

an induction-heating furnace which is located at the exit of the continuous-casting line and the power of which is adjusted so as to increase the temperature of the slabs to a mean value determined by the rolling requirements, without correcting the local temperature heterogeneities of each slab; and an equalizing or homogenizing zone or furnace located at the exit of said heating furnace, in order to correct the thermal heterogeneities inherent in each thin slab.

According to a preferred embodiment of the installation which is the subject of the invention, the heating furnace comprises motorized rollers, on which move the thin slabs produced by said continuous casting and between which are placed inductors fed by a medium-frequency generator, the delivered power of which is determined in real time by the mean temperature level of the thin slabs leaving the continuous casting, and the equalizing zone is equipped with conventional heating means, such as, particularly, fossil-fuel or residual-fuel burners or radiant elements of the resistor type.

DETAILED DESCRIPTION OF THE INVENTION

Other characteristics and advantages of this invention will emerge from the description given below with reference to the accompanying drawing, the single figure of which shows a diagrammatic side elevation view of a non-limiting exemplary embodiment of the installation according to the invention.

BRIEF DESCRIPTION OF THE DRAWING

Referring to the drawing, 10 denotes a continuous-casting machine of the conventional type producing a thin slab 12 which is cut to the desired length by a shearing device 14.

According to the invention, at the exit of the continuous-casting machine 10 there is an induction-heating furnace designated as a whole by the reference 16, in order to obtain the longest possible dwell time in view of the fact that the casting speeds are considerably lower than the rolling speeds. As can be seen in the figure, the thin slab coming from the continuous-casting machine 10 moves on motorized rollers, such as 22, between which are placed flat or solenoid or transverse coils 24 fed by a medium-frequency generator. The power delivered by this generator is determined in real time by the mean temperature level of the thin slabs leaving the continuous-casting machine. According to the invention, this mean level is either measured on the basis of the skin temperature of the slab by using any known means, such as, for example, a pyrometric sight, or calculated by means of a mathematical model of the solidification or cooling of the slab during casting.

In view of the characteristics of the induction heating on the metallurgical products, the temperature of which is considerably higher than the Curie point, the induction-heating furnace 16 provided in the installation which is the subject of the invention has the purpose and effect of increasing to a mean value determined by the rolling requirements the temperature of each of the slabs and of the portions of slabs coming from the continuous casting within a minimum time, though without correcting the local temperature heterogeneities of each of the slabs, especially between the edges and center or between the core and skin. To carry out this correction of the local temperature heterogeneities, the invention provides an equalizing or homogenizing zone or furnace 18 which is located at the exit of the heating furnace 16.

This equalizing zone 18 can use all conventional heating means, particularly fossil-fuel or residual-fuel burners or radiant elements of the resistor type. In this equalizing zone, the thermal transfers are obtained by gas radiation from the walls which are homogeneous and partly by convection.

The installation according to the invention, as a result of the combination of an induction-heating furnace located at the exit of the continuous-casting line and correcting the heterogeneities of temperature level between the slabs produced by the continuous casting and of an equalizing or homogenizing zone or furnace correcting the thermal heterogeneities inherent in each thin slab, makes it possible to considerably reduce the overall size of the heating equipment and deal with pronounced temperature deviations between the head, middle and tail of the cast slab, especially because the response times and the instantaneous variations in power delivered by the induction heating are markedly higher than those of a conventional heating furnace.

It goes without saying that this invention is not limited to the exemplary embodiment described and claimed here, but that it embraces all the alternative versions.

We claim:

1. A system for thermally treating thin metallic slabs prior to rolling, comprising:

means for continuously casting a thin metallic member;

means for shearing the member to form slabs of predetermined length;

means located downstream of the shearing means for inductively heating each sheared slab during a first period of time, in a first zone, to non-uniformly raise the temperature of the slab to a mean first preselected temperature;

means for further heating each slab for a second period of time, in a second zone downstream of the first zone, to uniformly raise the temperature of each slab to a second preselected temperature; and roller means for rolling the heated slab therebetween to achieve a preselected thickness.

2. The system set forth in claim 1 wherein motorized rollers move the slabs between the first and second heated zones, and further wherein the inductive heating means is connected to a medium frequency generator for delivering sufficient power to raise the temperature in the slab to the mean first temperature.

3. The system set forth in claim 1 wherein the further heating means comprises a radiantly heated oven.

4. The system set forth in claim 1 wherein detection of the first temperature is made by a pyrometric sight directed toward the slabs present in the first zone.

* * * * *